US008220401B2

(12) United States Patent
Hayashida

(10) Patent No.: US 8,220,401 B2
(45) Date of Patent: Jul. 17, 2012

(54) SEWING MACHINE FOR COVERING CHAIN STITCH

(75) Inventor: Takayuki Hayashida, Toyonaka (JP)

(73) Assignee: Yamato Mishin Seizo Kabushiki Kaisha, Osaka (JP)

( * ) Notice: Subject to any disclaimer, the term of this patent is extended or adjusted under 35 U.S.C. 154(b) by 393 days.

(21) Appl. No.: 12/567,101

(22) Filed: Sep. 25, 2009

(65) Prior Publication Data

US 2010/0077949 A1 Apr. 1, 2010

(30) Foreign Application Priority Data

Sep. 26, 2008 (JP) ..... 2008-248637

(51) Int. Cl.
*D05B 1/08* (2006.01)
*D05B 35/06* (2006.01)

(52) U.S. Cl. ..... 112/100; 112/197

(58) Field of Classification Search ..... 112/163, 112/165, 197, 100, 475.17, 220, 302
See application file for complete search history.

(56) References Cited

U.S. PATENT DOCUMENTS 1,405,855 A * 2/1922 Moffatt ..... 112/100
1,855,254 A * 4/1932 Moffatt ..... 112/100
3,882,806 A 5/1975 Marforio
5,383,414 A 1/1995 Winter et al.
5,544,604 A * 8/1996 Winter ..... 112/475.17
6,553,927 B1 * 4/2003 Kawai ..... 112/220
2006/0107885 A1 * 5/2006 Hasegawa ..... 112/302

FOREIGN PATENT DOCUMENTS

JP 49-94456 A 9/1974
JP 6-327857 A 11/1994
JP 2006-192189 A 7/2006
JP 2008-142498 A 6/2008

* cited by examiner

*Primary Examiner* — Ismael Izaguirre
(74) *Attorney, Agent, or Firm* — Birch, Stewart, Kolasch & Birch, LLP

(57) ABSTRACT

In a sewing machine for covering chain stitch according to the present invention, a thread push member is mounted on a top cover shaft which drives a cover thread looper, and the thread push member is arranged on the cover thread guide. When swinging backward in association with a movement of the cover thread looper, the thread push member pushes the top cover thread passing through a guide hole of the cover thread guide, forcibly moves the top cover thread and keeps the top cover thread near a back end of the guide hole. The top cover thread is arranged at a predetermined position on a surface of a cloth without being affected by a force from the needle thread, and a covering chain stitch can stably be formed with the excellent appearance.

14 Claims, 17 Drawing Sheets

SEWING MACHINE FOR COVERING CHAIN STITCH

This Nonprovisional application claims priority under 35 U.S.C. §119(a) on Patent Application No. 2008-248637 filed in Japan on Sep. 26, 2008, the entire contents of which are hereby incorporated by reference.

BACKGROUND OF THE INVENTION

1. Field of the Invention

The present invention relates to a sewing machine for covering chain stitch having a cover thread looper which arranges a top cover thread on a surface of a cloth in which stitches are formed by a plurality of needles.

2. Description of Related Art

In a sewing operation of a cloth having high elasticity such as knit fabric, a sewing machine for covering chain stitch described in Japanese Patent Publication Laid-Open No. 2008-142498 is widely employed. A stitch formed by the sewing machine for covering chain stitch has excellent elasticity and strength. The sewing machine for covering chain stitch includes a cover thread looper. The cover thread looper arranges a top cover thread on a surface of a cloth on which stitches are formed by a plurality of needles, so as to make the top cover thread regularly intertwine with the stitches. The top cover thread arranged by the cover thread looper makes appearance of the stitch excellent.

FIG. 1 is an enlarged perspective view showing a needle area of a conventional sewing machine for covering chain stitch. The sewing machine for covering chain stitch includes four needles 41*a* to 41*d* arranged on a plane which substantially intersects with a sending direction (front and back direction) of a cloth 200. The needles 41*a* to 41*d* are fixed to a lower end of a needle rod 4 through a needle stopper 45. The needles 41*a* to 41*d* move upward and downward by vertical motion of the needle rod 4. The needles 41*a* to 41*d* are provided with needle holes at their lower ends. Needle threads 42*a* to 42*d* are supplied from above so as to pass through the needle holes of the needles 41*a* to 41*d*, respectively, from the front side as shown in the drawing.

The sewing machine for covering chain stitch includes a looper (not shown) in a bed which supports a lower side of the cloth 200. The looper holds a looper thread and moves forward and rearward in an arranging direction (right and left direction) of the needles 41*a* to 41*d*. The forward and rearward movement of the looper is generated in synchronization with vertical movements of the needles 41*a* to 41*d*, and a stitch is formed on the cloth 200.

The sewing machine for covering chain stitch further includes a cover thread looper 90 and a cover thread guide 93 arranged on one side (right side) in the arranging direction of the needles 41*a* to 41*d*. The cover thread looper 90 is an arc member which swings in the right and left direction on the front side of the needles 41*a* to 41*d*. The cover thread looper 90 includes a thread hook 90*a* inside of the tip end. A top cover thread 100 is hooked on the thread hook 90*a*. The cover thread guide 93 includes a guide hole 93*a* which is long in the front and back direction, and the guide hole 93*a* is located on the upper side of the cover thread looper 90. A front end of the guide hole 93*a* is located frontward of positions where the needles 41*a* to 41*d* are arranged, and a back end of the guide hole 93*a* is located backward of the positions where the needles 41*a* to 41*d* are arranged.

The top cover thread 100 is supplied from above, passes through a small hole 44*a* of the thread-guide member 44 provided on the needle stopper 45 as shown in the drawing.

The top cover thread 100 is connected to the cloth 200 through a guide hole 93*a* of the cover thread guide 93. The top cover thread 100 is hooked on the thread hook 90*a* of the cover thread looper 90 swinging below the cover thread guide 93, and arranged on a surface of the cloth 200.

FIG. 2A and FIG. 2B are explanatory diagrams showing movement of the cover thread looper 90. The cover thread looper 90 swings between a receding position shown in FIG. 2A and a advancing position shown in FIG. 2B.

When the cover thread looper 90 is in the receding position, as shown in FIG. 2A, the thread hook 90*a* is opposed to a back side of the top cover thread 100 passing near a front end of the guide hole 93*a*. If the advancing motion of the cover thread looper 90 is started, the top cover thread 100 is hooked on the thread hook 90*a* on the tip end of the cover thread looper 90, the cover thread looper 90 goes around to a front side of the needles 41*a* to 41*d* while the cover thread looper 90 is pulled out from the guide hole 93*a*, and the cover thread looper 90 reaches the advancing position shown in FIG. 2B.

An appropriate tension is applied to the top cover thread 100. Thus, the top cover thread 100 slides in the guide hole 93*a* as the cover thread looper 90 is pulled out. Then, the top cover thread 100 moves to a back end of the guide hole 93*a*, and the top cover thread 100 is extended between the guide hole 93*a* and the thread hook 90*a*.

As shown in FIG. 1, the needles 41*a* to 41*d* are fixed to the needle stopper 45 such that their lower ends are opposing to the cover thread guide 93 and are sequentially positioned upward. As described above, the top cover thread 100 pulled out by the cover thread looper 90 is located above the lower ends of the left two needles 41*a* and 41*b*, and under the lower ends of the right two needles 41*c* and 41*d*. Therefore, the top cover thread 100 comes into contact with a front portion of the needle 41*b* and is bent as shown in FIG. 2B. Thus, the top cover thread 100 passes on the back side of the needle 41*c* and is continued to the guide hole 93*a* of the cover thread guide 93. In this state, the top cover thread 100 is pressed on a surface of the cloth 200 by the needle threads 42*a* to 42*d* of the needles 41*a* to 41*d*, and is arranged on the surface.

SUMMARY OF THE INVENTION

FIG. 3 is a perspective view showing a covering chain stitch as viewed from a front of the cloth. As shown in the drawing, the seams of the needle threads 42*a* to 42*d* are arranged on the surface of the cloth 200. The covering chain stitch is formed in an arrangement that the top cover thread 100 regularly waves across the seams. In FIG. 3, a hollow arrow shows a sending direction of the cloth 200.

In the conventional sewing machine for covering chain stitch, there is a problem that generates sewing failures called "thread-stitching" and "stitch skipping" deteriorating the appearance. The "thread-stitching" is a sewing failure generated when a needle pierces through the top cover thread 100 arranged on the cloth 200 as shown with a symbol "A" in FIG. 3. The "stitch skipping" is a sewing failure generated when the top cover thread 100 comes across a seam at a wrong position as shown with a symbol "B" in FIG. 3.

FIG. 4 is an explanatory diagram showing a mechanism of generation of sewing failure. FIG. 4 shows a positional relationship between the needle thread 42*d* of the needle 41*d* located at the leftmost position in FIG. 2, the cloth 200 and the top cover thread 100 from side. The needle 41*d* in the drawing is located at the top dead center (the uppermost position), the needle thread 42*d* extends diagonally downward backwardly from a needle hole of the needle 41*d*, and the needle thread

42*d* is continued to the cloth 200 (stitch on the cloth 200) in a state where an appropriate tension is applied to the needle thread 42*d*.

The top cover thread 100 is located under the tip end of the needle 41*d* and behind the needle 41*d* as described above. The needle thread 42*d* extending from the needle 41*d* toward the cloth 200 may come into contact with the top cover thread 100 located at such a position from behind.

Although a tension is surely applied to the top cover thread 100, the tension of the top cover thread 100 is generally smaller than that of the needle thread 42*d*. Thus, the top cover thread 100 is pushed by the needle thread 42*d* which contacts the top cover thread 100 from behind, and the top cover thread 100 is moved frontward as shown with broken lines in FIG. 4. This movement influences even a position behind the needle 41*c* which is adjacent to the needle 41*d*. Thus, the top cover thread 100 may pass directly below the needle 41*c* as shown with broken lines in FIG. 2B or may pass through a location in front of the needle 41*c*.

When the top cover thread 100 passes directly below the needle 41*c*, the lowering needle 41*c* pierces through the top cover thread 100, and the "thread-stitching" is generated. When the top cover thread 100 passes frontward the needle 41*c*, the lowering needle 41*c* passes behind the top cover thread 100 and the "stitch skipping" is generated.

The present invention has been accomplished in view of the above circumstances, and it is an object of the invention to provide a sewing machine for covering chain stitch capable of reliably arranging a top cover thread at a predetermined position on a surface of a cloth, and capable of forming a stitch having excellent appearance without generating sewing failures such as "thread-stitching" and "stitch skipping".

A sewing machine for covering chain stitch of the first invention includes a plurality of needles arranged in a direction intersecting with a sending direction, a cover thread guide which is arranged on one side of the needles in an arrangement direction and which has a guide hole being long in a front and back direction, and a cover thread looper which is located below the cover thread guide and which moves frontward and backward so as to come across a front side of the needles, in which a top cover thread passing through the guide hole is caught by the advancing cover thread looper and is pulled out, the top cover thread being guided through the guide hole and being arranged on a surface of the cloth, wherein the sewing machine for covering chain stitch further includes a thread push member that moves frontward and backward at a location above the cover thread guide in association with the cover thread looper, pushes by the backward movement the top cover thread which passes through the guide hole, and forcibly moves the top cover thread to a back side of the guide hole.

In the present invention, the thread push member moves frontward and backward at a location above the cover thread guide in association with the cover thread looper. When the thread push member moves backward, it presses the top cover thread which passes through a guide hole of the cover thread guide. The top cover thread is forcibly moved to a location near a back end of the guide hole by the pushing action of the thread push member, the top cover thread keeps the moved position against a tension of the needle thread which comes into contact the top cover thread from behind, and the top cover thread is reliably arranged at a predetermined position on a surface of a cloth.

According to the sewing machine for covering chain stitch of the second invention, the thread push member of the first invention is mounted on a drive shaft of the cover thread looper, and the sewing machine for covering chain stitch further includes a swinging rod swinging in accordance with repetitive pivot movement of the drive shaft.

In this invention, the thread push member is mounted on the top cover shaft which drives the cover thread looper, and a drive system for the cover thread looper and the thread push member are commonly used, and the object can be achieved with a simple structure.

The above and further objects and features of the invention will more fully be apparent from the following detailed description with accompanying drawings.

DETAILED DESCRIPTION OF THE INVENTION

Figure 5:
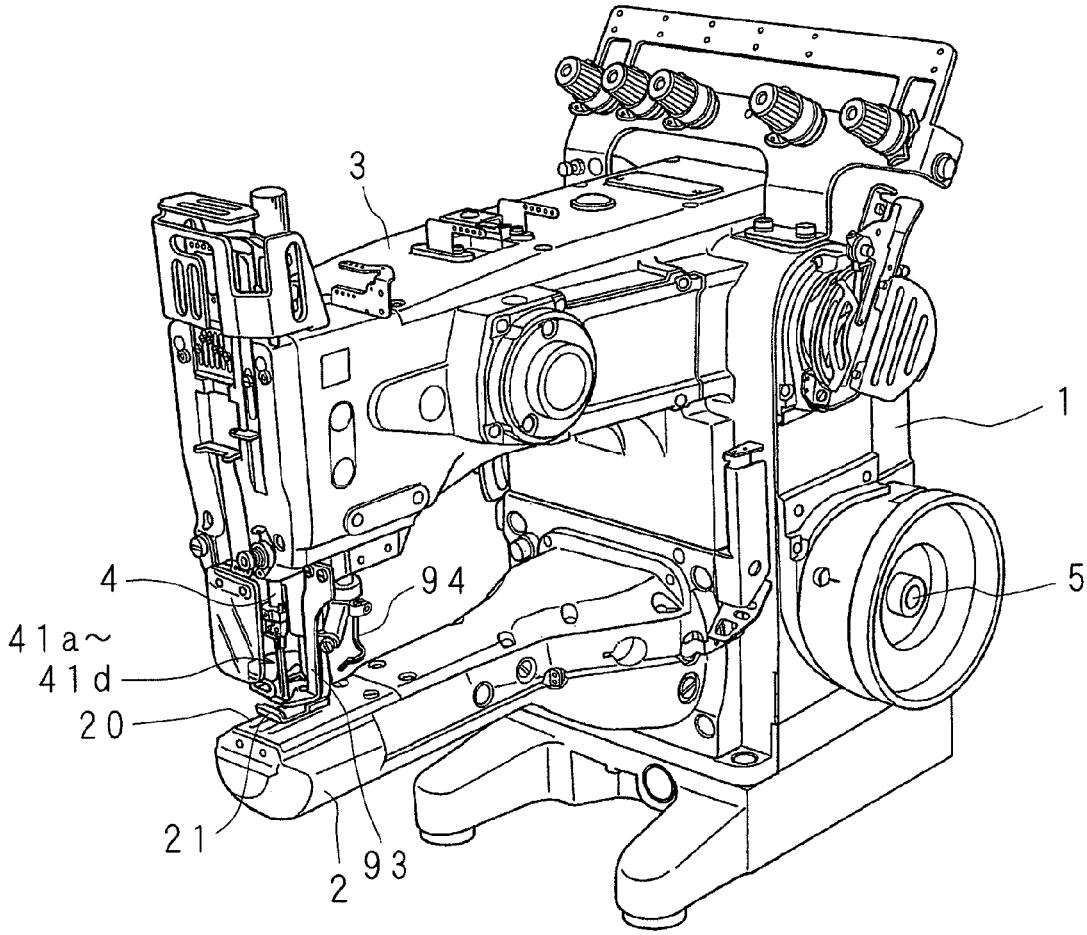
FIG. 5 is a perspective view showing an outward appearance of a sewing machine for covering chain stitch according to the present invention.
Figure 6:
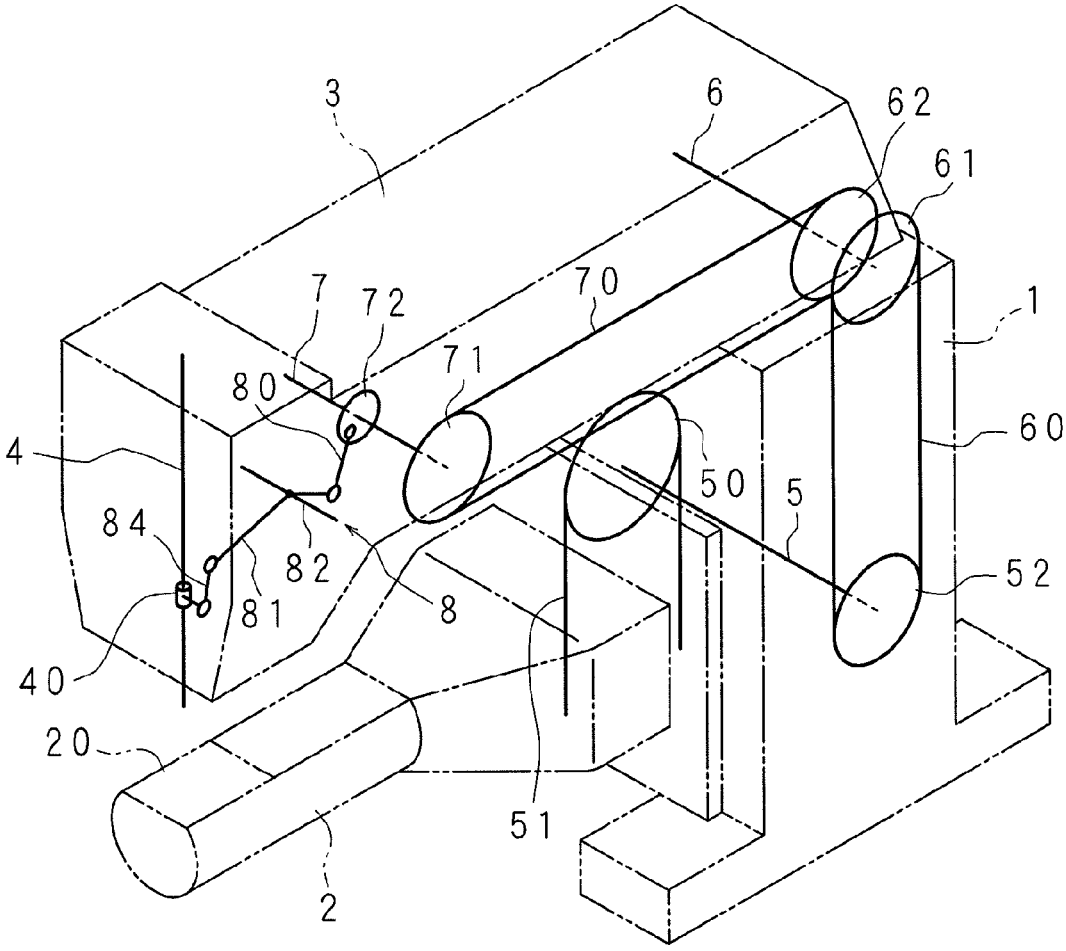
FIG. 6 is a schematic perspective view showing the entire structure of a transmission mechanism to a needle rod.
Figure 7:
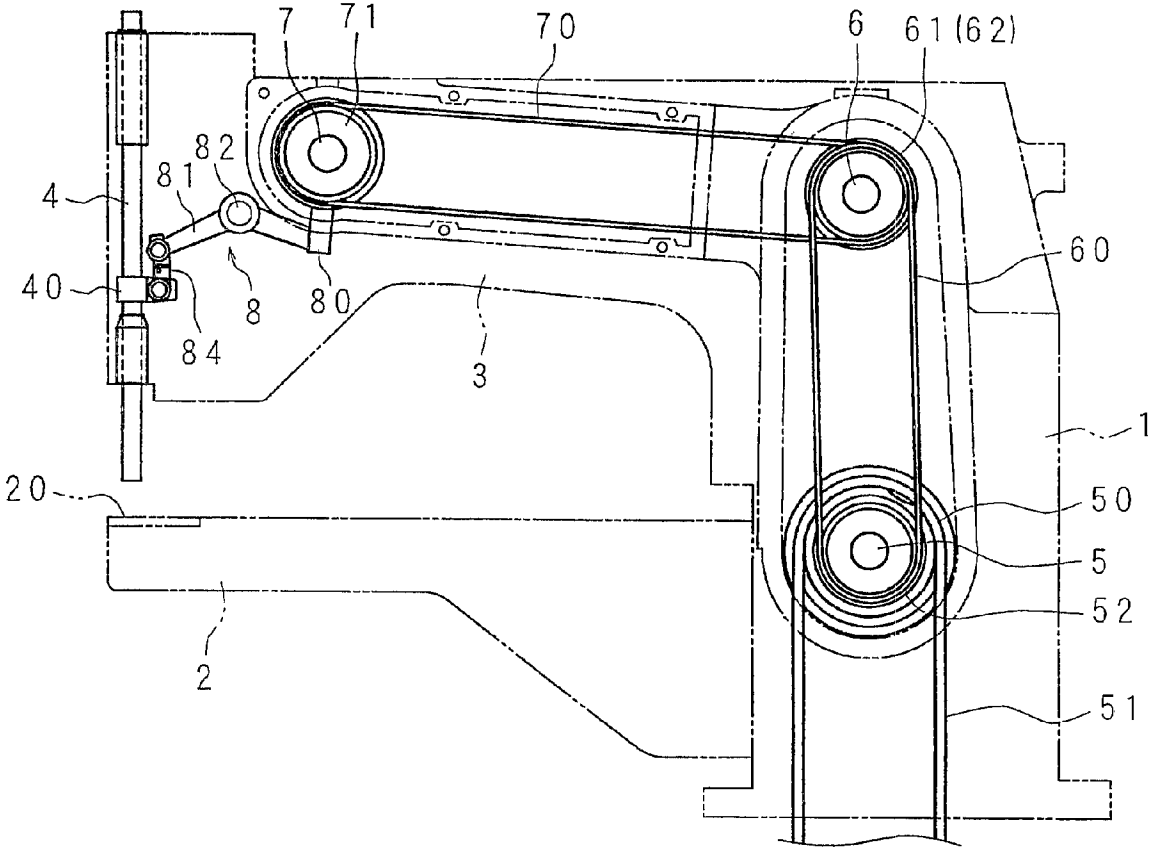
FIG. 7 is a side view showing the transmission mechanism to the needle rod.

The present invention will be described in detail based on the drawings which show a preferable embodiment thereof. FIG. 5 is a perspective view showing an outward appearance of a sewing machine for covering chain stitch according to the present invention. FIG. 6 is a schematic perspective view showing the entire structure of a transmission mechanism to a needle rod. FIG. 7 is a side view showing the transmission mechanism shown in FIG. 6.

The sewing machine for covering chain stitch shown in the drawings is constituted as a longitudinal cylindrical sewing machine in which a small-diameter cylindrical bed 2 projects from a lower portion of one side of a sewing machine body 1, and a sewing machine arm 3 projects substantially in parallel to the cylindrical bed 2 above the cylindrical bed 2 on the same side.

A needle plate 20 is provided on an upper surface of a tip end of the cylindrical bed 2. A sending device and a looper (both not shown) are provided in the cylindrical bed 2 below the needle plate 20. A needle rod 4 is supported on a tip end of the sewing machine aim 3. Four needles 41*a* to 41*d* are mounted on a lower end of the needle rod 4 projecting downward from the sewing machine arm 3 through a needle stopper 45 (see FIG. 10). A press bar (not shown) is supported on the tip end of the sewing machine arm 3. The press bar projects downward of the sewing machine arm 3 behind the needle rod 4 (on the side of a base end of the cylindrical bed 2), and a press metal 21 is mounted on this projecting end.

The cloth 200 (see FIGS. 11 to 16) is sandwiched between the press metal 21 and the needle plate 20, and is sent from a tip end side (front side) to a base end side (back side) of the cylindrical bed 2 by the operation of the sending device. The needles 41*a* to 41*d* are arranged in a direction intersecting with the sending direction of the cloth 200. The needles 41*a* to 41*d* move upward and downward in synchronization with the sending movement of the cloth 200. The looper moves forward and rearward in the arranging direction (right and left direction) of the needles 41*a* to 41*d* in synchronization with the sending movement of the cloth 200. The cloth 200 is sewed by the operations of the needles 41*a* to 41*d* and the looper.

A sewing machine main shaft 5 is provided at a lower portion in the sewing machine body 1. The sewing machine main shaft 5 extends in the right and left direction. The sewing machine main shaft 5 is connected to an output end of the sewing machine motor (not shown) by a drive belt 51 which is wound around a drive pulley 50 of one end (left end). The sewing machine main shaft 5 is rotated and driven by the sewing machine motor through the drive belt 51 and the drive pulley 50.

A transmission shaft 6 is provided at an upper portion in the sewing machine body 1. The transmission shaft 6 is substantially in parallel to the sewing machine main shaft 5, and the transmission shaft 6 is supported at a position corresponding to a height of the projecting portion of the sewing machine arm 3. Through a transmission belt 60 wound around a transmission pulley 61 of one end (right end), the transmission shaft 6 is connected to a transmission pulley 62 of the other end (right end) of the sewing machine main shaft 5. The transmission shaft 6 is rotated around a center axis by rotation of the sewing machine main shaft 5 transmitted through the transmission belt 60.

A needle rod drive shaft 7 is provided near the needle rod 4 inside a tip end of the sewing machine aim 3. The needle rod drive shaft 7 is in almost parallel to the sewing machine main shaft 5 and the transmission shaft 6. The needle rod drive shaft 7 is connected to a transmission pulley 62 arranged on an end of the transmission shaft 6 on the same side in a side by side relation with the transmission pulley 61 by a transmission belt 70 wound around a transmission pulley 71 on one end (right end). The needle rod drive shaft 7 rotates around a center axis by rotation of the transmission shaft 6 transmitted through the transmission belt 70.

Figure 8:
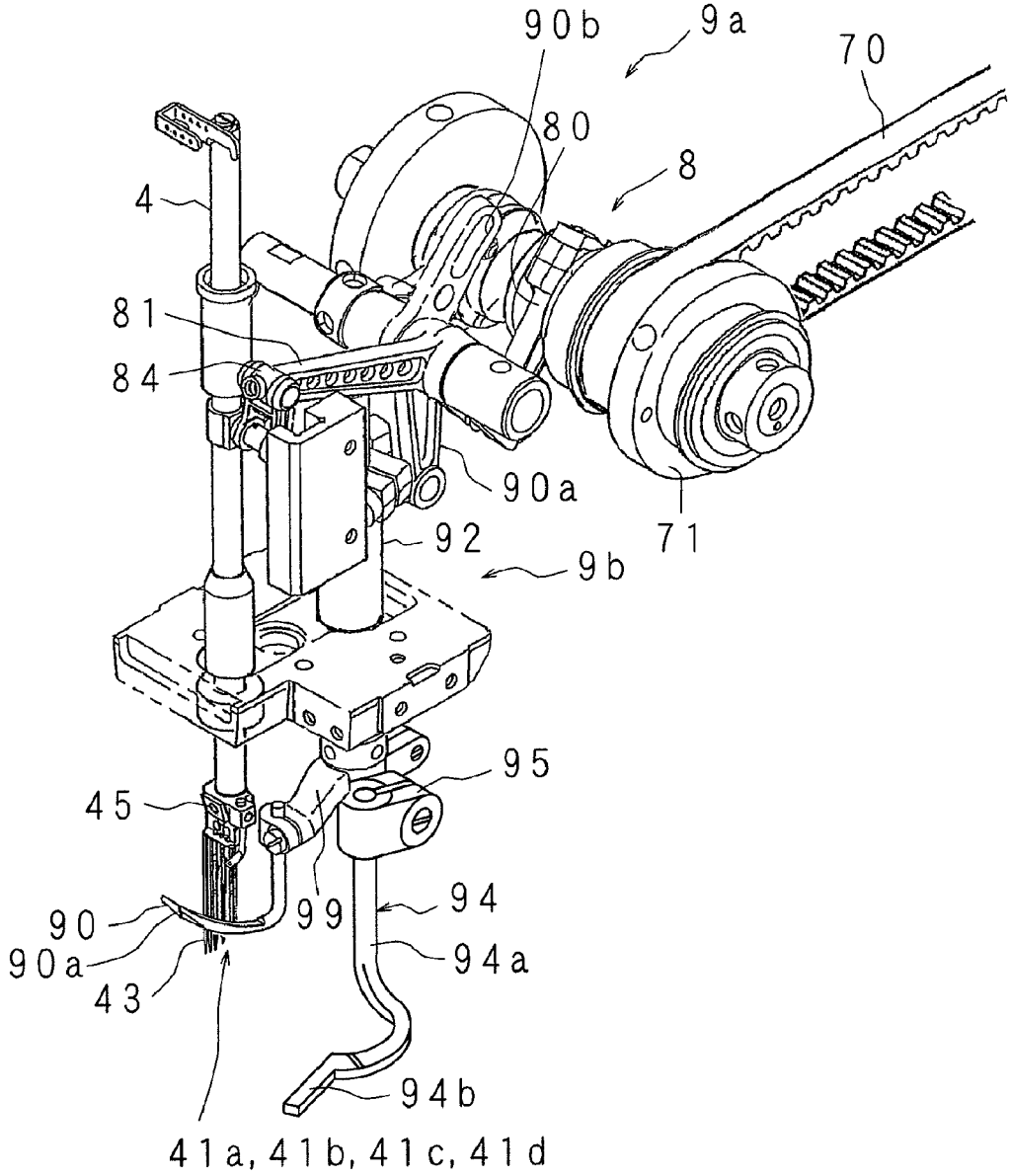
FIG. 8 is a perspective view showing a movement-converting mechanism and a top cover transmission mechanism.
Figure 9:
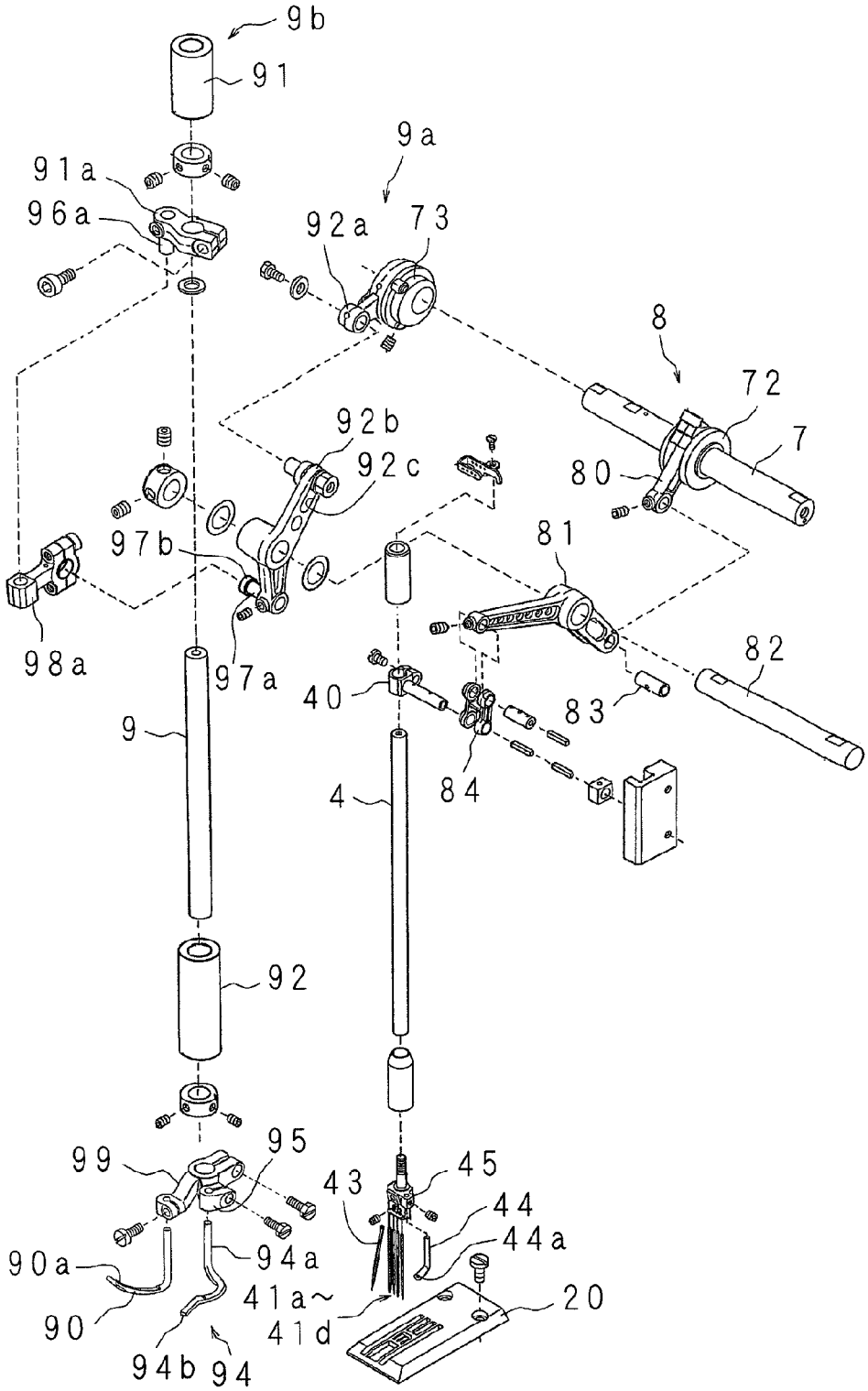
FIG. 9 is an exploded perspective view showing the movement-converting mechanism and the top cover transmission mechanism.

The needle rod drive shaft 7 is connected to the needle rod 4 through a movement-converting mechanism 8 shown in FIGS. 8 and 9. The needle rod drive shaft 7 is connected to a top cover device 9*b* by a top cover transmission mechanism 9*a* shown in FIGS. 8 and 9. FIG. 8 is a perspective view showing the movement-converting mechanism 8 and the top cover transmission mechanism 9*a*. FIG. 9 is an exploded perspective view showing the movement-converting mechanism 8 and the top cover transmission mechanism 9*a*. The movement-converting mechanism 8 includes a crank arm 80 and a needle swing aim 81. As shown in FIG. 9, a needle rod crank 72 having a predetermined eccentricity is provided at an intermediate portion of the needle rod drive shaft 7 as shown in FIG. 9, and a base end of the crank arm 80 is connected to the needle rod crank 72. An intermediate portion of the needle swing arm 81 is supported by a support shaft 82 which is in parallel to the needle rod drive shaft 7 so that the needle swing arm 81 can swing around an axis of the support shaft 82. One end of the needle swing arm 81 extending toward the needle rod drive shaft 7 is connected to a tip end of the crank arm 80 through a connecting shaft 83, and the other end of the needle swing arm 81 extending toward the needle rod 4 is connected to a needle rod holder 40 fixed to an intermediate portion of the needle rod 4 through short links 84. With this above structure, rotation of the needle rod drive shaft 7 is transmitted to the needle swing arm 81 through the crank arm 80 connected to the needle rod crank 72, and the needle swing arm 81 swings around the support shaft 82 such that one period of the needle swing arm 81 corresponds to one rotation of the needle rod drive shaft 7. With this swinging movement, the other end of the needle swing arm 81 vertically moves, and this vertical movement is transmitted to the needle rod 4 through the links 84 and the needle rod holder 40, and the needle rod 4 vertically reciprocates during strokes corresponding to the swinging angle of the needle swing arm 81.

A needle stopper 45 is fixed to a lower end of the needle rod 4. The four needles 41*a* to 41*d* are mounted on the needle stopper 45 in this order from left to right. A retainer 43 is mounted on the needle stopper 45 on the left side of the needle 41*a*. The needles 41*a* to 41*d* and the retainer 43 mounted on the needle stopper 45 are moved upward and downward between the top dead center and the bottom dead center by the vertical movement of the needle rod 4. The needles 41*a* to 41*d* moving upward and downward sew a cloth on the needle plate 20 in cooperation with the looper which moves forward and rearward. When the retainer 43 moves downward, the retainer 43 reaches the inside of the cylindrical bed 2 together with the needles 41*a* to 41*d*, and the retainer 43 catches and holds a looper thread held by the looper as is known. The top cover device 9*b* includes a top cover shaft 9, a cover thread looper 90 and a thread push member 94. The top cover shaft 9 is supported by bearing bushes 91 and 92 at upper and lower walls of the sewing machine arm 3, and the top cover shaft 9 can rotate around a vertical axis.

A lower end of the top cover shaft 9 projects downward of the sewing machine arm 3, and the cover thread looper 90 is mounted on the projecting end of the top cover shaft 9 through a looper stage 99. The cover thread looper 90 includes a shaft portion extending downward from the looper stage 99 and a curved portion which is continued to a lower end of the shaft portion and curved into an arc shape on a plane (plane which is substantially in parallel to the needle plate 20) substantially intersecting with an axial direction. The curved portion of the cover thread looper 90 is provided with a thread hook 90*a* which inwardly projects near the tip end. The thread push member 94 is mounted on a holding stage 95 which is integrally provided on the looper stage 99. The thread push member 94 includes a connecting shaft 94*a* extending downward from the holding stage 95, and a swinging rod 94*b* which is formed by bending a lower portion of the connecting shaft 94*a* substantially at right angles and which is substantially in parallel to the needle plate 20.

The top cover transmission mechanism 9*a* transmits rotation movement of the needle rod drive shaft 7 to the top cover shaft 9, and repeatedly turns the top cover shaft 9. The top cover transmission mechanism 9*a* includes a top cover lever 92*b*, a swing arm 91*a*, a top cover crank arm 92*a* and a connection link 98*a*. The top cover lever 92*b* is supported by a support shaft 82 which is common to the needle swing arm 81. Thus, the top cover lever 92*b* can swing around the support shaft 82.

As shown in FIG. 9, a top cover crank 73 having a predetermined eccentricity is provided on an intermediate portion of the needle rod drive shaft 7 as shown in FIG. 9. The top cover crank 73 is arranged on one side of the needle rod crank 72 in a side by side relation. A base portion of the top cover crank arm 92*a* is connected to the top cover crank 73. A tip end of the top cover crank arm 92*a* extending frontward is connected to one end of the top cover lever 92*b*. As shown in FIG. 9, this connected position can be adjusted along a long hole 92*c* formed in the top cover lever 92*b*. A connection pin 97*a* extending leftward substantially in parallel to the support shaft 82 is provided on the other end of the top cover lever 92*b* extending downward from the supported position by the support shaft 82.

The swing aim 91*a* is located between upper and lower bearing bushes 91 and 92 and fixed to the top cover shaft 9. As shown in FIG. 9, a tip end of the swing arm 91*a* is provided with a connection pin 96*a* which extends downward. The swing arm 91*a* and the top cover lever 92*b* are connected to each other through a connection link 98*a*. Both ends of the connection link 98*a* are fitted to the connection pin 96*a* and the connection pin 97*a*. The connection link 98*a* and the connection pin 97*a* are fitted to each other through a ball joint 97*b*.

With the above structure, rotation movement of the needle rod drive shaft 7 is transmitted to the top cover lever 92*b* through the top cover crank 73 and the top cover crank arm 92*a*. The top cover lever 92*b* swings around the support shaft 82, and one period of the top cover lever 92*b* corresponds to one rotation of the needle rod drive shaft 7. This swinging angle can be changed by adjusting a connected position between the top cover crank arm 92*a* and the top cover lever 92*b*. The swinging movement of the top cover lever 92*b* generated in this manner is transmitted to the swing arm 91*a* through the connection link 98*a*, and the top cover shaft 9 on which the swing arm 91*a* is mounted repeatedly turns through an angle corresponding to the swinging angle of the top cover lever 92*b*.

Figure 10:
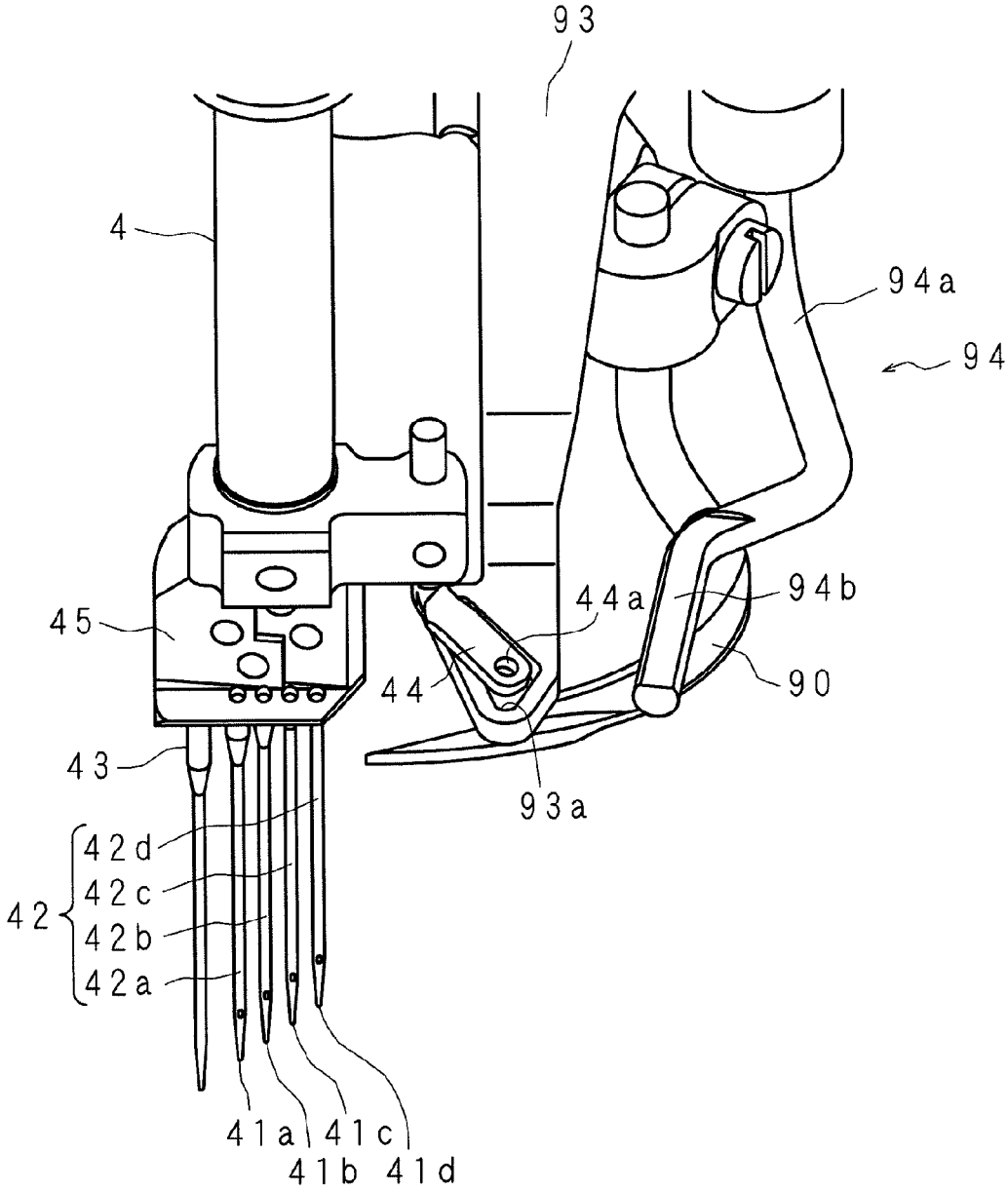
FIG. 10 is an enlarged perspective view showing needles of the sewing machine for covering chain stitch of the present invention.

FIG. 10 is an enlarged perspective view showing the needles of the sewing machine for covering chain stitch of the present invention. As described above, the cover thread looper 90 mounted on the top cover shaft 9 is located on the right side of the rightmost needle 41*d* as shown in FIG. 10. The cover thread looper 90 swings in accordance with the repetitive pivot movement of the top cover shaft 9. A tip end of the curved portion having the thread hook 90*a* advances until it reaches a left position with respect to the left needle 41*a* as coming across a front side of the arrangement positions of the needles 41*a* to 41*d*.

A cover thread guide 93 similar to a guide of the conventional sewing machine for covering chain stitch is arranged at a position on the cover thread looper 90. As shown in FIG. 5, the cover thread guide 93 is mounted on a front surface of the sewing machine aim 3 as extending downward. The cover thread guide 93 includes a plate portion formed by bending a lower end thereof such as to intersect with the top cover shaft 9 (in parallel to the needle plate 20). The plate portion is provided with a guide hole 93*a* which is long in the front and back direction. A front end of the guide hole 93*a* is located frontward of the arrangement positions of the needles 41*a* to 41*d*, and a back end of the guide hole 93*a* is located backward of the arrangement positions of the needles 41*a* to 41*d*.

The swinging rod 94*b* of the thread push member 94 mounted on the top cover shaft 9 is located at a higher position than the plate portion of the cover thread guide 93, and a tip end of the swinging rod 94*b* is located frontward of a front end of the guide hole 93*a*. The swinging rod 94*b* of the thread push member 94 located in such a position swings in synchronization with the cover thread looper 90 in accordance with repetitive pivot movement of the top cover shaft 9. The swinging movement of the swinging rod 94*b* is generated in a range which passes through an upper side of the guide hole 93*a* provided in the cover thread guide 93 and reaching a back end portion from a front side frontward of a front end of the guide hole 93*a*.

FIGS. 11 to 16 are explanatory diagrams for explaining a series of movement of the needles 41*a* to 41*d*, the cover thread looper 90 and the thread push member 94. FIG. 17A and FIG. 17B are explanatory diagrams showing the movement of the cover thread looper 90 and the thread push member 94. FIG. 17A corresponds to FIG. 11, and FIG. 17B corresponds to FIG. 13.

Figure 11:
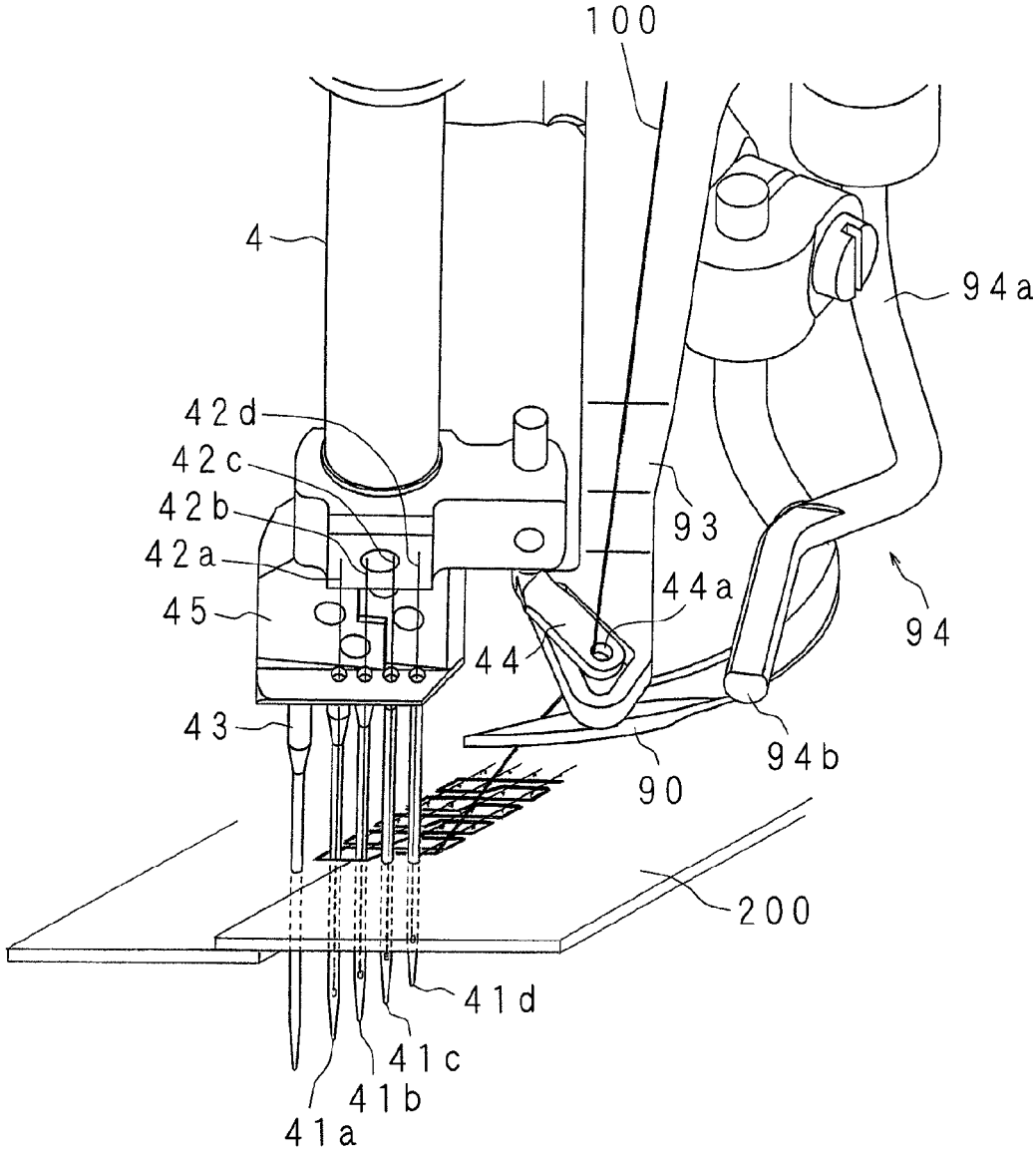
FIG. 11 is an explanatory diagram showing movement of the needle, the cover thread looper and the thread push member.
Figure 13:
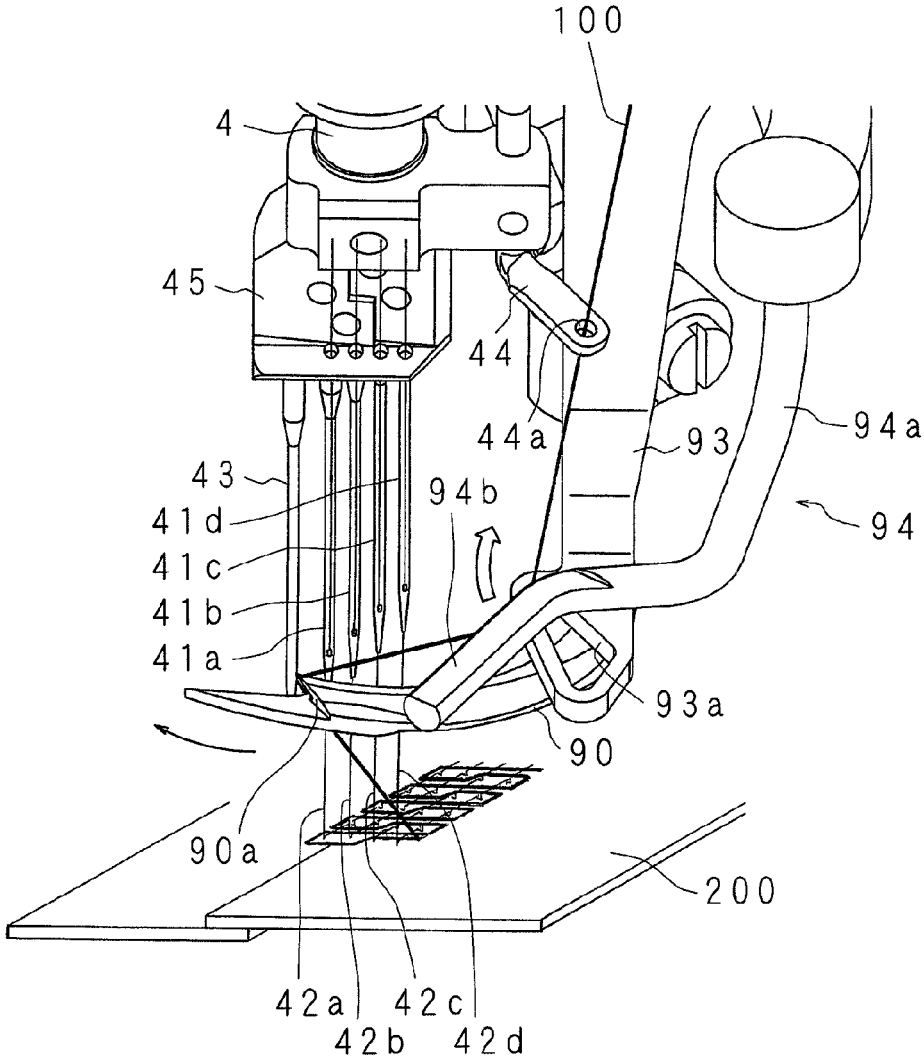
FIG. 13 is an explanatory diagram showing movement of the needle, the cover thread looper and the thread push member.

As described above, the needles 41*a* to 41*d* move upward and downward between the top dead center and the bottom dead center, and the cover thread looper 90 and the thread push member 94 swing between the receding position shown in FIG. 17A and the advancing position shown in FIG 17B in synchronization with the vertical movements of the needles 41*a* to 41*d*. When the cover thread looper 90 and the thread push member 94 are in the receding position, the needles 41*a* to 41*d* are near the bottom dead center, and penetrate the cloth 200 as shown in FIG. 11. When the cover thread looper 90 and the thread push member 94 are in the advancing position, the needles 41*a* to 41*d* are near the top dead center, and are separated above the cloth 200 by a predetermined distance as shown in FIG. 13. The needles 41*a* to 41*d* are provided at their lower ends with needle holes. The needle threads 42*a* to 42*d* are supplied from above as shown in the drawings, and they respectively pass through the needle holes of the needles 41*a* to 41*d* from front side. The thread-guide member 44 extending upward of a front end of the guide hole 93*a* of the cover thread guide 93 is mounted on a front surface of the needle stopper 45 which fixes the needles 41*a* to 41*d*. A small hole 44*a* is formed and vertically penetrates at an extended end of the thread-guide member 44. The top cover thread 100 is supplied from above, passes through the small hole 44*a* formed at the thread-guide member 44 as shown in the drawing, passes through the guide hole 93*a* of the cover thread guide 93 and is continued to the cloth 200. The top cover thread 100 is hooked on the thread hook 90*a* of the cover thread looper 90 swinging below the guide hole 93*a*, and is arranged on the surface of the cloth 200, as will be described later. The thread push member 94 swings above the guide hole 93*a* and influences the top cover thread 100, as will be described later.

When the cover thread looper 90 is in the receding position, the thread hook 90*a* is opposed to a back side of the top cover thread 100 passing near a front end of the guide hole 93*a* as shown in FIG. 17A. When the advancing action of the cover thread looper 90 is started, the top cover thread 100 is hooked on the tip end thread hook 90*a*. Then, the top cover thread 100 is pulled out from the guide hole 93*a*, goes around front of the needles 41*a* to 41*d*, and reaches the advancing position shown in FIG. 17B. An appropriate tension is applied to the top cover thread 100. When being pulled out, the top cover thread 100 slides in the guide hole 93*a* by the tension, moves backward of the guide hole 93*a*, and is tightened between the position after the movement and the thread hook 90*a*.

The cover thread looper 90 advances as shown with a solid arrow in

Figure 12:
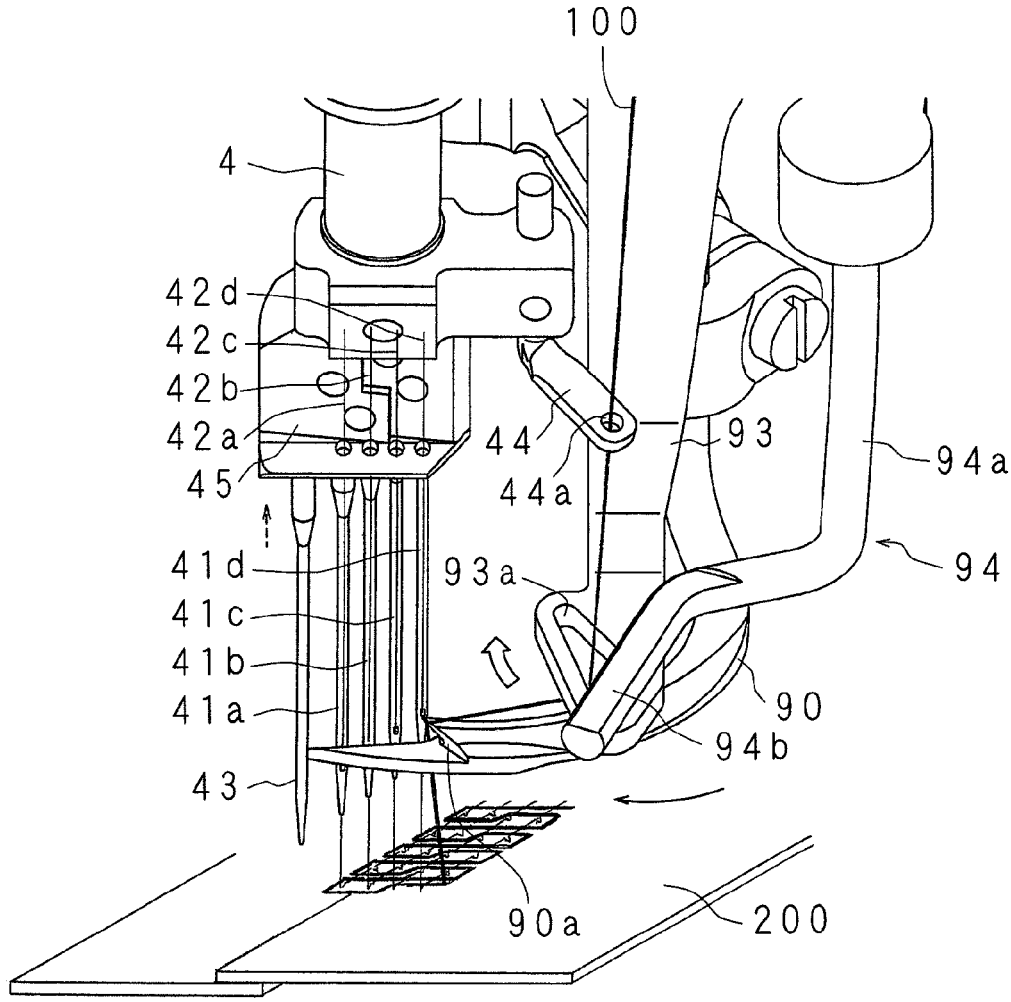
FIG. 12 is an explanatory diagram showing movement of the needle, the cover thread looper and the thread push member.

FIG. 12. With this movement, the top cover thread 100 is hooked on the tip end thread hook 90*a*, the top cover thread 100 is pulled out from the guide hole 93*a* while the top cover thread 100 goes to front of the arrangement positions of the needles 41*a* to 41*d* from the side of the right needle 41*d*. The swinging rod 94*b* of the thread push member 94 swings as shown with a hollow arrow in FIG. 12, and approaches the top cover thread 100 passing through the guide hole 93*a* of the cover thread guide 93 from front. The needles 41*a* to 41*d* move upward together with the thread-guide member 44, as shown by an arrow of broken line in FIG. 12.

When the needles 41*a* to 41*d* move upward and reach the top dead center, the cover thread looper 90 reaches the advancing position shown in FIGS. 13 and 17B. At that time, the thread hook 90*a* of the cover thread looper 90 is located on a left and front side of the needle 41*a*. The swinging rod 94*b* of the thread push member 94 influences the top cover thread 100 above the guide hole 93*a*, and the swinging rod 94*b* pushes the top cover thread 100 backward. The top cover thread 100 is guided to a location near the back end of the guide hole 93*a* by this pushing action, and the top cover thread 100 is prevented from moving frontward from this position. The top cover thread 100 can keeps a stable tightened attitude between a location near the back end of the guide hole 93*a* and the thread hook 90*a* of the cover thread looper 90 located at the advancing position. This tightened attitude is not varied by an external force applied to the top cover thread 100 backward.

Positions of the lower ends of the four needles 41*a* to 41*d* are different from each other as described above. When the needles 41*a* to 41*d* are at the top dead center, the lower ends of the left two needles 41*a* and 41*b* are located below the top cover thread 100, and the lower ends of the right two needles 41*c* and 41*d* are located above the top cover thread 100. Therefore, the top cover thread 100 tightened between the guide hole 93*a* and the thread hook 90*a* comes into contact with a front portion of the needle 41*b* and bends as shown in FIG. 17B, and the top cover thread 100 passes a back side of the needle 41*c* and is continued to the guide hole 93*a* of the cover thread guide 93. The top cover thread 100 is further bent back at the thread hook 90*a*, diagonally comes across a back side of the arrangement position of the needles 41*a* to 41*d*, and is continued to a stitch which was previously formed on the cloth 200.

Figure 14:
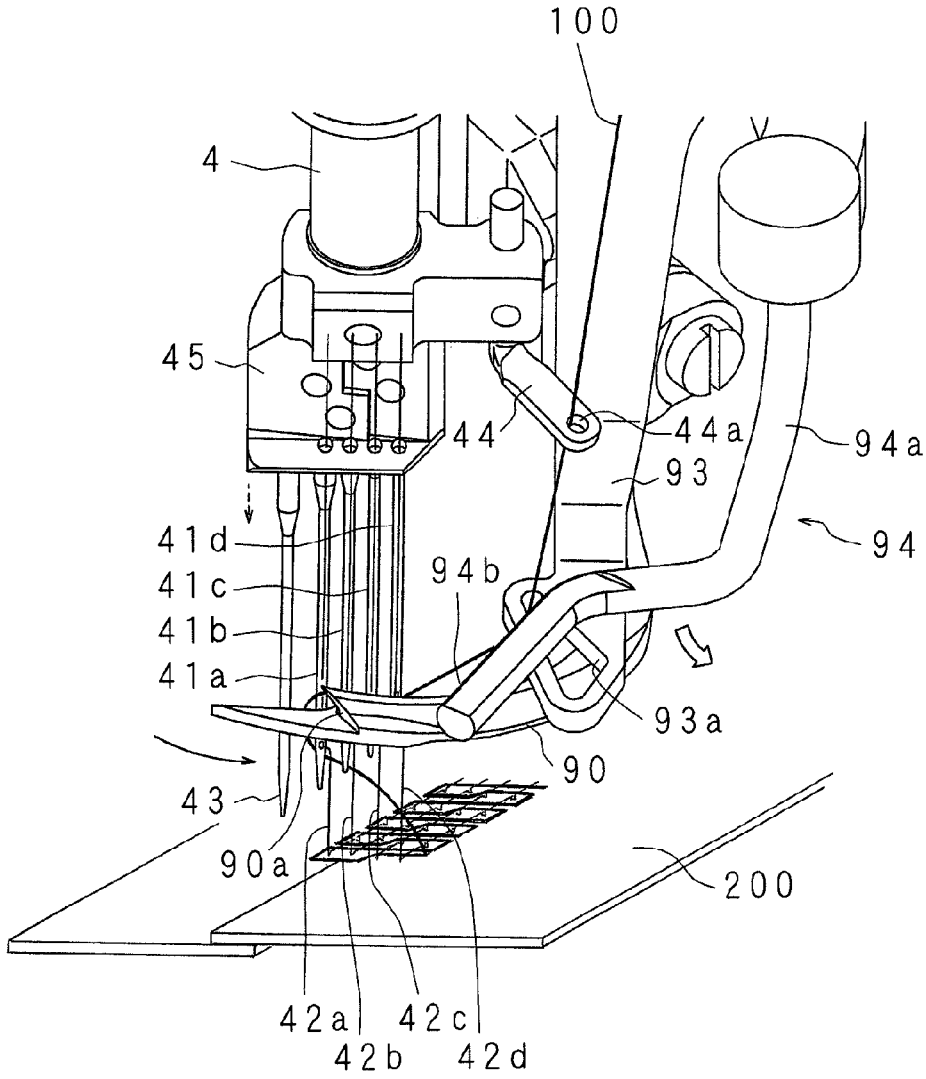
FIG. 14 is an explanatory diagram showing movement of the needle, the cover thread looper and the thread push member.

After the needles 41*a* to 41*d* reach the top dead center, the needles 41*a* to 41*d* move downward as shown by an arrow of broke line in FIG. 14. Then, the needle threads 42*a* to 42*d* and the top cover thread 100 are intertwined with each other. At that time, the cover thread looper 90 swings rightward as shown by a solid arrow in FIG. 14, and the top cover thread 100 comes out from the thread hook 90*a*. At that time, the swinging rod 94*b* of the thread push member 94 swings frontward as shown by a hollow arrow in FIG. 14. Thus, the pressure of the top cover thread 100 is released.

Figure 15:
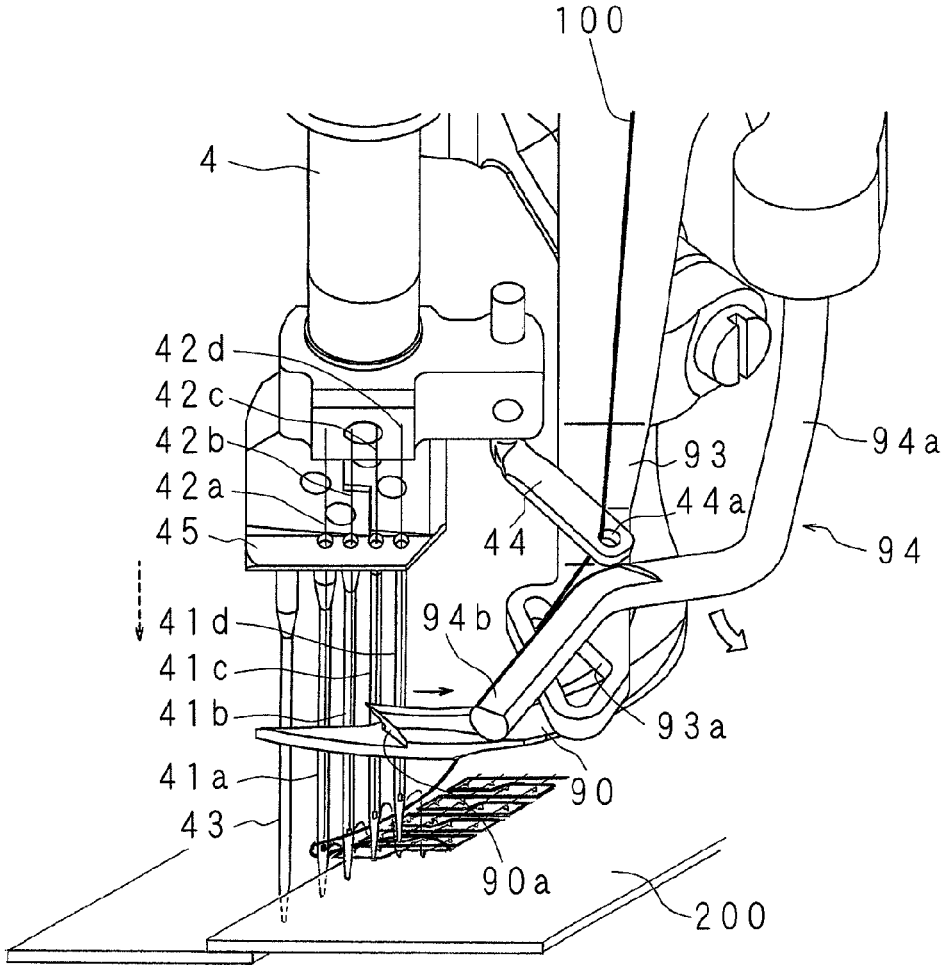
FIG. 15 is an explanatory diagram showing movement of the needle, the cover thread looper and the thread push member.
Figure 16:
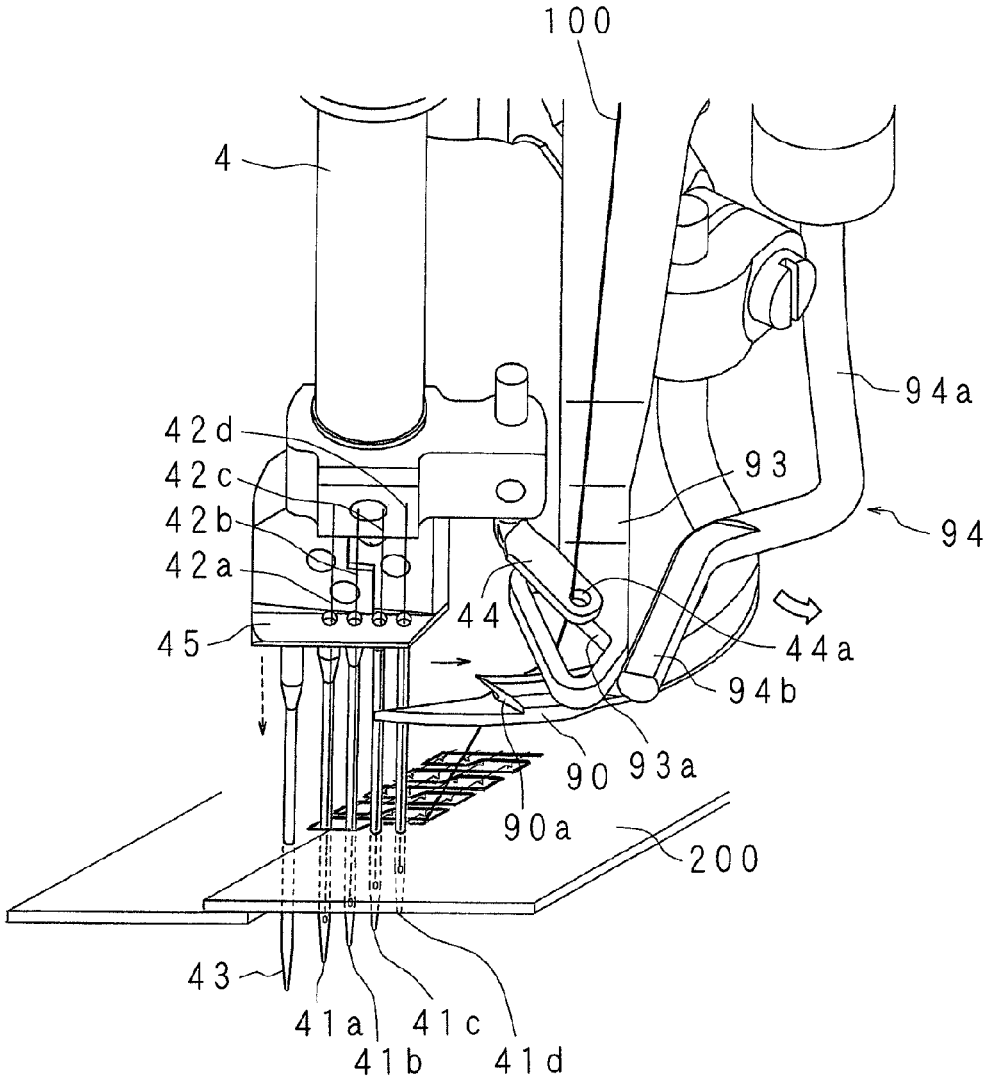
FIG. 16 is an explanatory diagram showing movement of the needle, the cover thread looper and the thread push member.
Figure 17A:
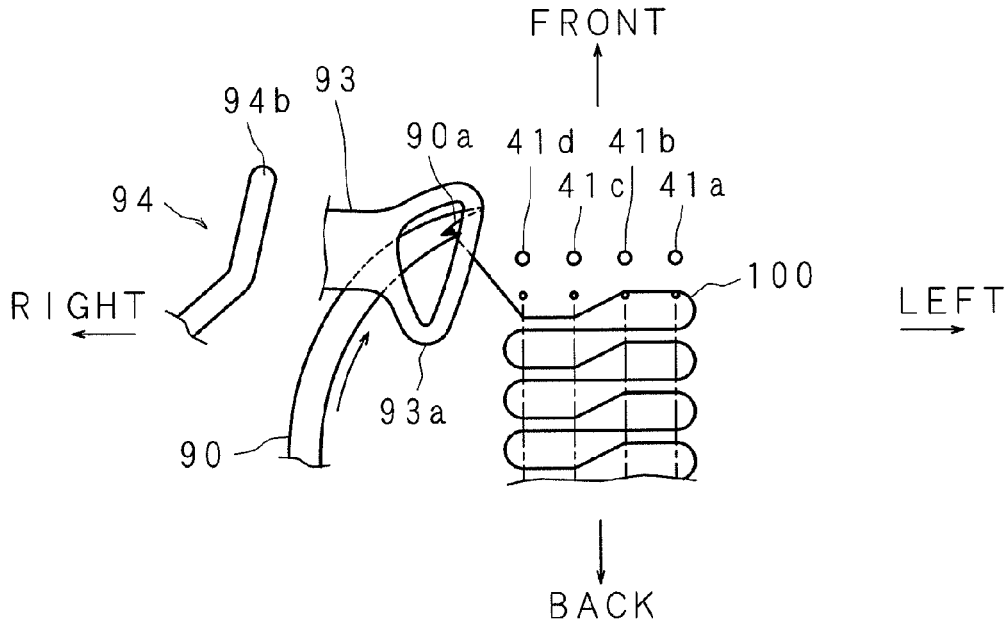
FIGS. 17A and 17B are explanatory diagrams showing the cover thread looper and the thread push member.
Figure 17B:
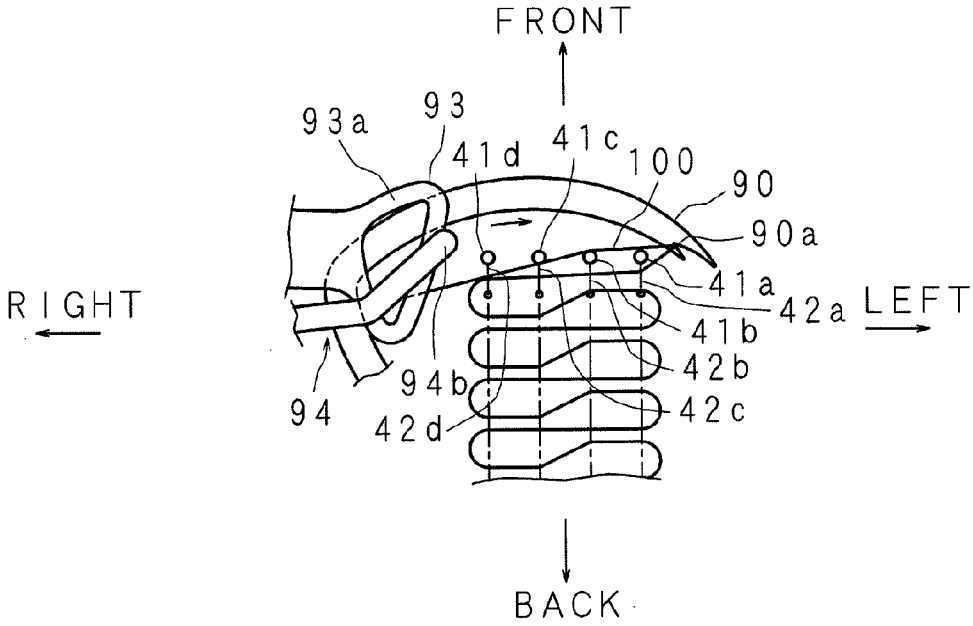

The needles 41*a* to 41*d* further move downward and penetrate the cloth 200 as shown in FIG. 15, return to the bottom dead center as shown in FIG. 16, and press the top cover thread 100 against the surface of the cloth 200. The cover thread looper 90 keeps swinging rightward, the thread hook 90*a* of the cover thread looper 90 moves away from the front positions of the needles 41*a* to 41*d*, and returns to the receding position as shown in FIG. 16. Similarly, the swinging rod 94*b* of the thread push member 94 keeps swinging frontward, moves away from the front end of the guide hole 93*a* and returns to the receding position as shown in FIG. 16.

Figure 4:
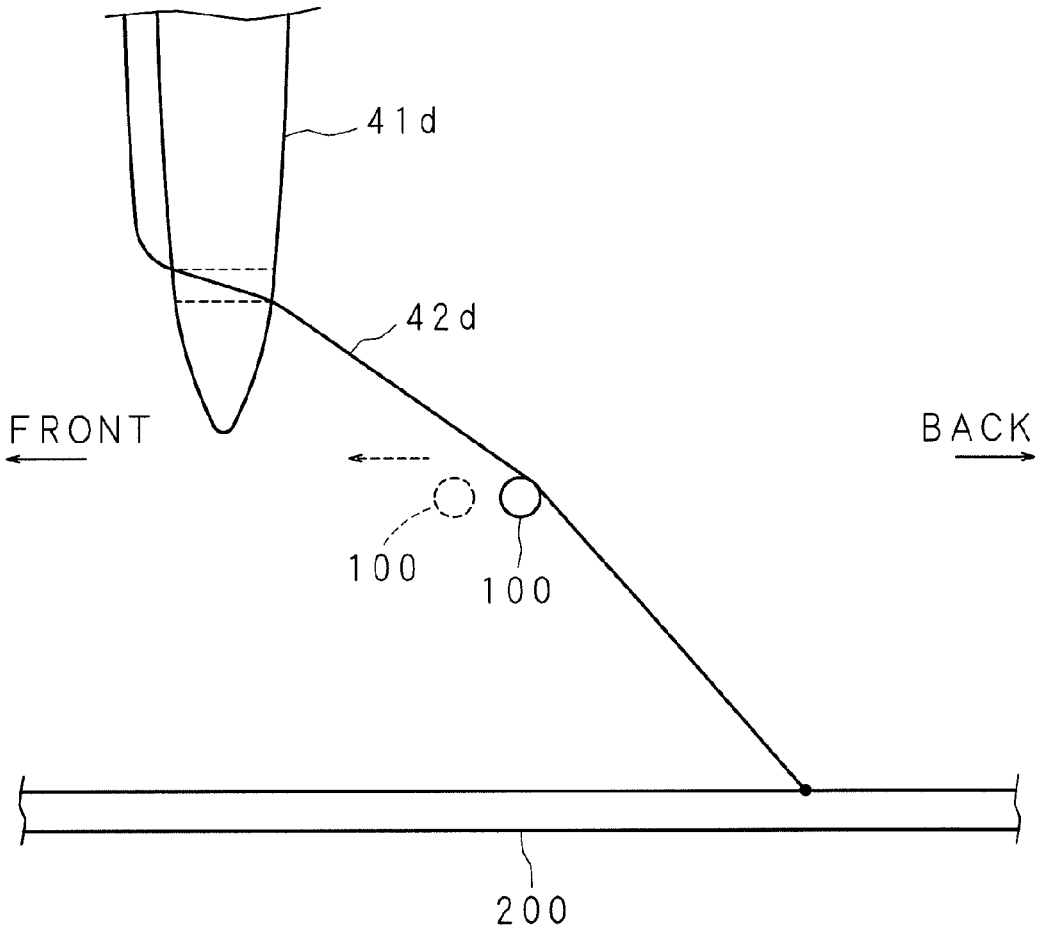
FIG. 4 PRIOR ART
FIG. 4 is a conventional explanatory diagram showing a generation of sewing failure.

Even in the sewing machine for covering chain stitch according to the present invention which is operated as described above, the needle thread 42*d* extending from the needle hole of the right needle 41*d* to the cloth 200 may come into contact with the top cover thread 100 passing the back side of the needles 41*a* to 41*d* from behind and may apply a frontward pushing force, as explained using FIG. 4, when the needles 41*a* to 41*d* are at the top dead center.

However, in the sewing machine for covering chain stitch according to the present invention, the top cover thread 100 is pushed backward by the swinging rod 94*b* of the thread push member 94, and is prevented from moving away from the vicinity of the back end of the guide hole 93*a* formed in the cover thread guide 93. Therefore, the top cover thread 100 is not moved frontward by a force applied from the needle thread 42*d* which comes into contact from behind, and the tightened attitude of the top cover thread 100 is not varied.

Figure 1:
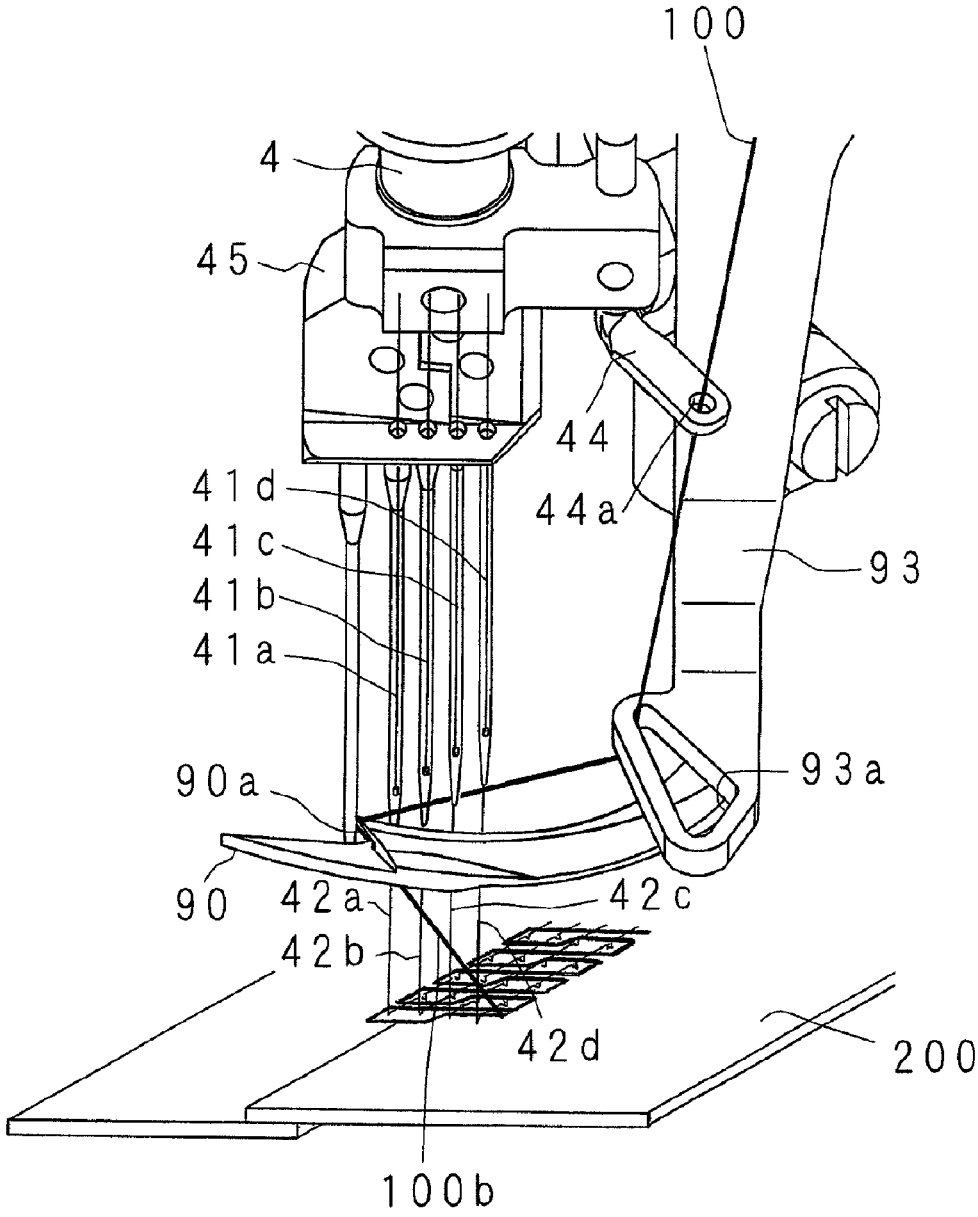
FIG. 1 PRIOR ART
FIG. 1 is an enlarged perspective view showing needles of a conventional sewing machine for covering chain stitch.
Figure 2A:
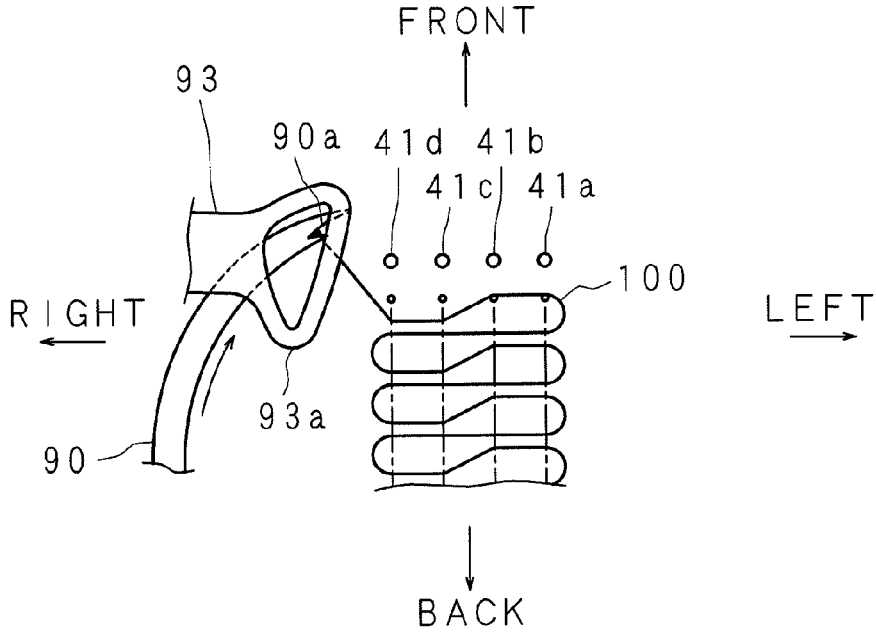
FIG. 2A PRIOR ART
FIGS. 2A and 2B are explanatory diagrams showing conventional movement of a cover thread looper.
Figure 2B:
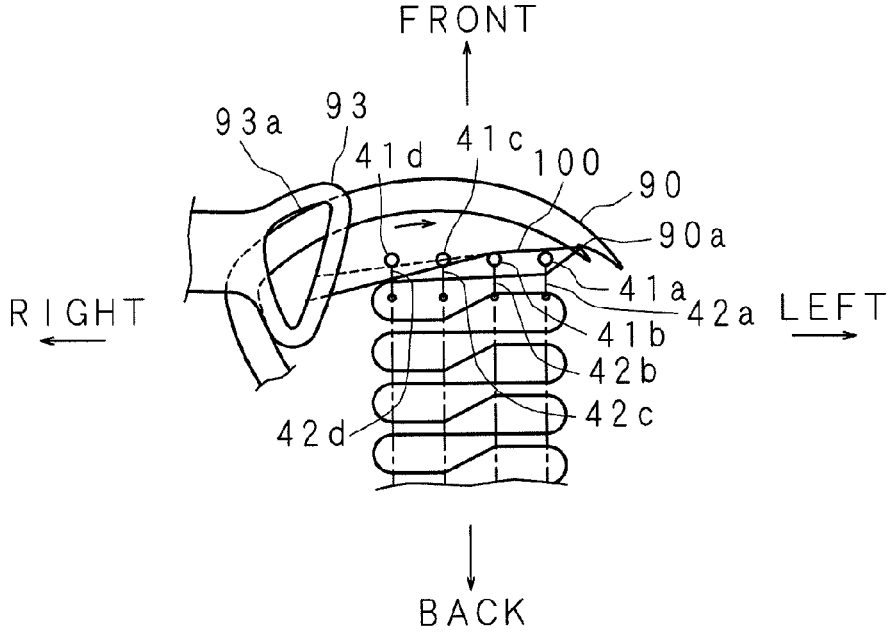
FIG. 2B PRIOR ART
Figure 3:
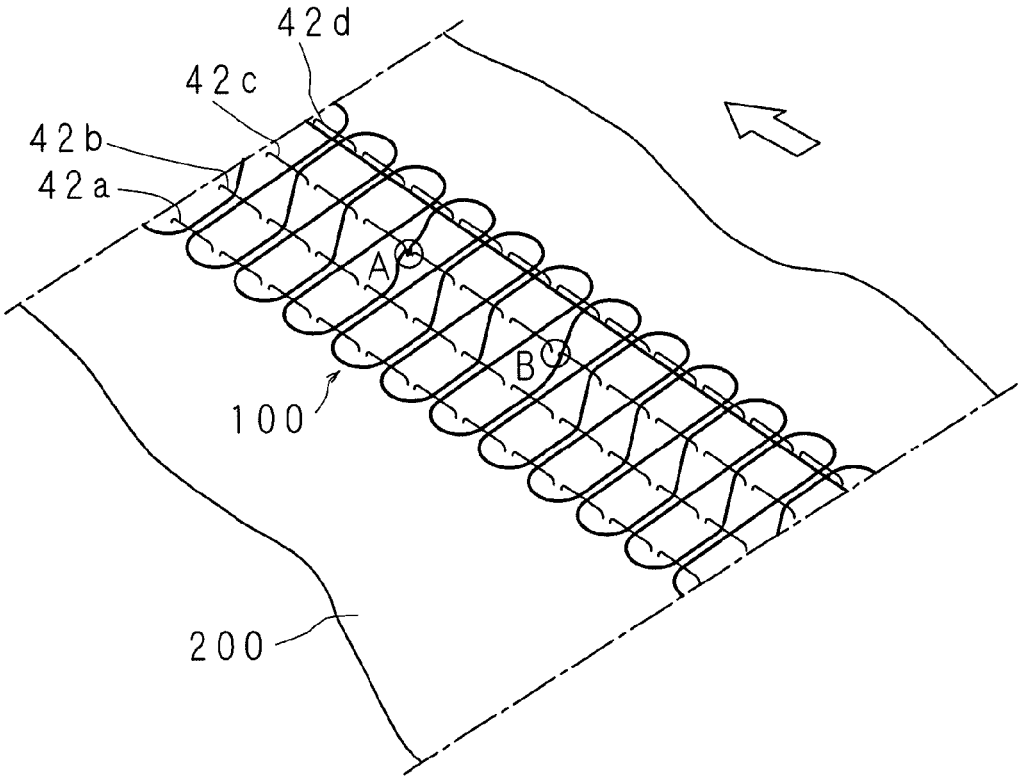
FIG. 3 PRIOR ART
FIG. 3 is a conventional perspective view showing a covering chain stitch as viewed from a surface of a cloth.

In the sewing machine for covering chain stitch of the present invention, it is possible to prevent the sewing failure such as "thread-stitching" and "stitch skipping" shown in FIG. 3 from being generated, and covering chain stitches can stably be formed excellent appearance. The thread push member 94 is mounted on the top cover shaft 9 which drives the cover thread looper 90, and the thread push member 94 functions as the top cover shaft 9 and the drive mechanism and thus, the object can be achieved with a simple structure. Although the sewing machine for covering chain stitch having the four needles 41*a* to 41*d* is explained in this embodiment, the present invention can also be applied to a sewing machine for covering chain stitch having two or three needles or a multi-needle sewing machine for covering chain stitch having five or more needles and a similar effect can be obtained.

As apparent from the detailed description, in the sewing machine for covering chain stitch according to the present invention, the top cover thread passing through the guide hole of the cover thread guide is pressed by the thread push member which moves frontward and backward in association with the cover thread looper, and forcibly moves it backward of the guide hole. Thus, the top cover thread is arranged at a predetermined position on the surface of the cloth without being affected by contact with the needle thread. Therefore, it is possible to prevent the sewing failure such as "thread-stitching" and "stitch skipping" from being generated, and covering chain stitches can stably be formed with excellent appearance.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A sewing machine for covering chain stitch that performs sewing operation of a cloth sent frontward, comprising:

a plurality of needles that sew the cloth and are configured with not less than three needles arranged in a right and left direction, wherein a needle at one side in the right and left direction among the plurality of needles is arranged above a position where another needle at another side in the right and left direction among the plurality of needles is arranged;

a cover thread guide that has a guide hole being longer in a front and back direction and guides, through the guide hole, a supplied top cover thread;

a cover thread looper that catches and pulls out the top cover thread guided by the cover thread guide; and a thread push member that pushes the top cover thread, wherein the top cover thread guided by the cover thread guide is arranged on a surface of the cloth in association with movement of the cover thread looper and the thread push member, the cover thread looper is arranged under the cover thread guide and performs advancing and receding movements while crossing in front of the plurality of needles, and the thread push member is arranged above the cover thread guide, swings synchronously with the movement of the cover thread looper and forcibly moves the top cover thread, against a thread tension of the cover thread, toward a back side of the guide hole by swinging.

2. A sewing machine according to claim 1, further comprising:

a holding stage that is connected to a drive shaft of the cover thread looper and holds the thread push member, wherein the thread push member comprises:

a shaft that extends downward from the holding stage; and a swinging rod that is connected to an under end portion of the shaft and extends in the right and left direction.

3. A sewing machine according to claim 2, wherein a drive shaft of the cover thread looper is arranged in and up and down direction, an under end portion of the drive shaft of the cover thread looper is connected to a looper stage, and the holding stage is separately formed from the looper stage, and attached to the drive shaft of the cover thread looper, to be adjustable in its own position around the drive shaft of the cover thread looper.

4. A sewing machine for covering chain stitch that performs sewing operation of a cloth sent frontward, comprising:

a plurality of needles that sew the cloth and are arranged in a right and left direction;

a cover thread guide that has a guide hole being longer in a front and back direction and guides, through the guide hole, a supplied top cover thread;

a cover thread looper that catches and pulls out the top cover thread guided by the cover thread guide; and a thread push member that pushes the top cover thread, wherein the top cover thread guided by the cover thread guide is arranged on a surface of the cloth in association with movement of the cover thread looper and the thread push member, the cover thread looper is arranged under the cover thread guide and performs advancing and receding movements while crossing in front of the plurality of needles, and the thread push member is arranged above the cover thread guide, swings synchronously with the movement of the cover thread looper and forcibly moves the top cover thread toward a back side of the guide hole by swinging.

5. A sewing machine for covering chain stitch that performs sewing operation of a cloth sent frontward, comprising:

a plurality of needles that sew the cloth and are arranged in a right and left direction;

a cover thread guide that has a guide hole being longer in a front and back direction and guides, through the guide hole, a supplied top cover thread;

a cover thread looper that catches and pulls out the top cover thread guided by the cover thread guide; and a thread push member that pushes the top cover thread, wherein the top cover thread guided by the cover thread guide is arranged on a surface of the cloth in association with movement of the cover thread looper and the thread push member, the plurality of needles move up and down between a top dead center and a bottom dead center, for sewing; and when the plurality of needles are at the top dead center, the top cover thread guided by the cover thread guide contacts with a front part of a needle among the plurality of needles, passes backward another needle among the plurality of needles and is tightened between the thread push member and the cover thread looper.

6. A sewing machine for covering chain stitch that performs sewing operation of a cloth sent frontward, comprising:

a plurality of needles that sew the cloth and are arranged in a right and left direction;

a cover thread guide that has a guide hole being longer in a front and back direction and guides, through the guide hole, a supplied top cover thread;

a cover thread looper that catches and pulls out the top cover thread guided by the cover thread guide; and a thread push member that pushes the top cover thread, wherein the top cover thread guided by the cover thread guide is arranged on a surface of the cloth in association with movement of the cover thread looper and the thread push member, the thread push member comprises a swinging rod that moves to swing synchronously with the movement of the cover thread looper; and the top cover thread is pushed backward by the swinging rod.

7. A sewing machine according to claim 6, wherein the thread push member is mounted on a drive shaft of the cover thread looper; and the swinging rod moves to swing in accordance with a repetitive pivot movement of the drive shaft.

8. A sewing machine for covering chain stitch that performs sewing operation of a cloth sent frontward, comprising:

a plurality of needles that sew the cloth and are configured with not less than three needles arranged in a right and left direction, wherein a needle at one side in the right and left direction among the plurality of needles is arranged above a position where another needle at another side in the right and left direction among the plurality of needles is arranged;

a cover thread guide means having a guide hole being longer in a front and back direction for guiding, through the guide hole, a supplied top cover thread;

a cover thread looper means for catching and pulling out the top cover thread guided by the cover thread guide means; and a thread push means for pushing the top cover thread, wherein the top cover thread guided by the cover thread guide means is arranged on a surface of the cloth in association with movement of the cover thread looper means and the thread push means, the cover thread looper means is arranged under the cover thread guide means and performs advancing and receding movements while crossing in front of the plurality of needles, and the thread push means is arranged above the cover thread guide means, swings synchronously with the movement of the cover thread looper means and forcibly moves the top cover thread, against a thread tension of the cover thread, toward a back side of the guide hole by swinging.

9. A sewing machine according to claim 8, further comprising:

a holding stage that is connected to a drive shaft of the cover thread looper means and holds the thread push means, wherein the thread push means comprises:

a shaft that extends downward from the holding stage; and a swinging rod that is connected to an under end portion of the shaft and extends in the right and left direction.

10. A sewing machine according to claim 9, wherein a drive shaft of the cover thread looper means is arranged in and up and down direction, an under end portion of the drive shaft of the cover thread looper means is connected to a looper stage, and the holding stage is separately formed from the looper stage, and attached to the drive shaft of the cover thread looper means, to be adjustable in its own position around the drive shaft of the cover thread looper means.

11. A sewing machine for covering chain stitch that performs sewing operation of a cloth sent frontward, comprising:

a plurality of needles that sew the cloth and are arranged in a right and left direction;

a cover thread guide means having a guide hole being longer in a front and back direction for guiding, through the guide hole, a supplied top cover thread;

a cover thread looper means for catching and pulling out the top cover thread guided by the cover thread guide means; and a thread push means for pushing the top cover thread, wherein the top cover thread guided by the cover thread guide means is arranged on a surface of the cloth in association with movement of the cover thread looper means and the thread push mean, the cover thread looper means is arranged under the cover thread guide means and performs advancing and receding movements while crossing in front of the plurality of needles, and the thread push means is arranged above the cover thread guide means, swings synchronously with the movement of the cover thread looper means and forcibly moves the top cover thread toward a back side of the guide hole by swinging.

12. A sewing machine for covering chain stitch that performs sewing operation of a cloth sent frontward, comprising:

a plurality of needles that sew the cloth and are arranged in a right and left direction;

a cover thread guide means having a guide hole being longer in a front and back direction for guiding, through the guide hole, a supplied top cover thread;

a cover thread looper means for catching and pulling out the top cover thread guided by the cover thread guide means; and a thread push means for pushing the top cover thread, wherein the top cover thread guided by the cover thread guide means is arranged on a surface of the cloth in association with movement of the cover thread looper means and the thread push mean, the plurality of needles move up and down between a top dead center and a bottom dead center, for sewing; and when the plurality of needles are at the top dead center, the top cover thread guided by the cover thread guide means contacts with a front part of a needle among the plurality of needles, passes backward another needle among the plurality of needles and is tightened between the thread push means and the cover thread looper means.

13. A sewing machine for covering chain stitch that performs sewing operation of a cloth sent frontward, comprising:

a plurality of needles that sew the cloth and are arranged in a right and left direction;

a cover thread guide means having a guide hole being longer in a front and back direction for guiding, through the guide hole, a supplied top cover thread;

a cover thread looper means for catching and pulling out the top cover thread guided by the cover thread guide means; and a thread push means for pushing the top cover thread, wherein the top cover thread guided by the cover thread guide means is arranged on a surface of the cloth in association with movement of the cover thread looper means and the thread push mean, the thread push means comprises a swinging rod that moves to swing synchronously with the movement of the cover thread looper means; and the top cover thread is pushed backward by the swinging rod.

14. A sewing machine according to claim 13, wherein the thread push means is mounted on a drive shaft of the cover thread looper means; and the swinging rod moves to swing in accordance with a repetitive pivot movement of the drive shaft.

* * * * *